US006619749B2

(12) United States Patent
Willy

(10) Patent No.: US 6,619,749 B2
(45) Date of Patent: Sep. 16, 2003

(54) READY-TO-ASSEMBLE ARTICLES OF FURNITURE

(76) Inventor: Scott Willy, 1870 E. 106$^{th}$ St., Carmel, IN (US) 46032

( * ) Notice: Subject to any disclaimer, the term of this patent is extended or adjusted under 35 U.S.C. 154(b) by 0 days.

(21) Appl. No.: 10/199,875

(22) Filed: Jul. 19, 2002

(65) Prior Publication Data

US 2003/0107255 A1 Jun. 12, 2003

Related U.S. Application Data

(60) Provisional application No. 60/339,172, filed on Dec. 11, 2001.

(51) Int. Cl.$^{7}$ ..... A47C 7/00

(52) U.S. Cl. ..... 297/440.13; 297/440.23; 297/440.15; 297/440.18; 297/440.21; 40/781; 40/784; 362/131; 362/431; 108/180; 108/158.12

(58) Field of Search ..... 297/440.13, 440.1, 297/440.14, 440.15, 440.16, 440.18, 440.21, 440.23; 40/761, 762, 763, 764, 780, 781, 784, 785; 362/127, 131, 134, 401, 410, 414, 431, 441, 450; 108/180, 158.12, 165

(56) References Cited

U.S. PATENT DOCUMENTS 2,334,912 A * 11/1943 Eide
2,543,875 A * 3/1951 Silverman
2,825,101 A * 3/1958 Rubenstein
3,485,527 A * 12/1969 Barghout
3,527,497 A * 9/1970 Self
3,788,700 A * 1/1974 Wartes
4,082,356 A * 4/1978 Johnson
4,140,065 A * 2/1979 Chacon
4,145,827 A * 3/1979 Katsufrakis
4,165,572 A * 8/1979 Sussman
5,082,329 A * 1/1992 Mars
5,263,766 A * 11/1993 McCullough
5,653,531 A * 8/1997 Yang
5,803,548 A * 9/1998 Battle
5,992,938 A * 11/1999 Jones
6,264,349 B1 * 7/2001 Morter

* cited by examiner

*Primary Examiner*—Laurie K. Cranmer
(74) *Attorney, Agent, or Firm*—Maginot, Moore & Bowman

(57) ABSTRACT

A ready-to-assemble (RTA) furniture system includes a collection of identically configured side panels, with sets of the side panels having different aesthetic and/or functional features, a collection of base panels and back panels spanning between pairs of side panels, the collection of base and back panels being provided in different sets of lengths and configurations to permit construction of different types of furniture. The panels are interconnected through a series of slots and notches. A locking member is provided that can be wedged into a slot to lock the entire RTA furniture item together. A second locking member can be provided to be wedged into a slot in the back panel to provide additional support for a base panel. A wide variety of furniture items are show that can be constructed using the two locking members.

20 Claims, 17 Drawing Sheets

READY-TO-ASSEMBLE ARTICLES OF FURNITURE

This application claims priority to U.S. provisional application Ser. No. 60/339,172, filed on Dec. 11, 2001, in the name of the same inventor and bearing the same title.

BACKGROUND OF THE INVENTION

The present invention relates generally to articles of furniture. More specifically, the invention concerns furniture that is "ready-to-assemble" or knockdown.

Knock-down or ready-to-assemble furniture has long been a welcome substitute for the traditional, one-piece, articles of furniture. Ready-to-assemble, or RTA, furniture is significantly cheaper than its more formal counterpart, which makes it a viable option for the college student furnishing a dorm room or a first-time apartment dweller or home buyer. Moreover, RTA furniture is popular with children because of the wide range of configurations that can be achieved with this type of furniture.

RTA furniture is also popular with parents because it represents an affordable alternative for furnishing a child's room or recreation or TV room that is subject to abnormal wear and tear. It is well-known that children, and particularly teenagers and young adults, can be extremely hard on furniture. Rather than spend a large amount of money on traditional furniture that will have its ordinary useful life cut short, many parents prefer to furnish with cheaper articles of furniture, such as RTA furniture. While the cheaper furniture may have a shorter life, the much lower cost makes periodic replacement preferable.

Knock-down or RTA furniture has been around for decades. Most prior RTA furniture relies upon interlocking notches and maintaining a tight fit between the spliced notches to keep the article of furniture solid. Of course, over time, the notches would wear and the fit between the components would become so sloppy as to render the article nearly unusable.

In addition, most prior RTA furniture has required specific sets of components, configured to generate a specific type of furniture. Thus, if a consumer wanted a chair, it was necessary to obtain a chair kit, and if a sofa was desired, a sofa kit was required. Knock-down furniture of this type does not take advantage of one possible benefit of RTA furniture, namely the ability to instantly convert one article to another article using many of the same components.

There remains a need for RTA furniture that is both inexpensive and versatile. The furniture must be able to achieve solid construction and to maintain its integrity over long periods of usage. In addition, the RTA furniture must have a desirable, and sometimes fun, appearance.

DESCRIPTION OF THE DRAWINGS

These needs are met by a novel RTA furniture array that is reflected in the following written description together with the accompanying figures.

DESCRIPTION OF THE PREFERRED EMBODIMENTS

Figure 1A:
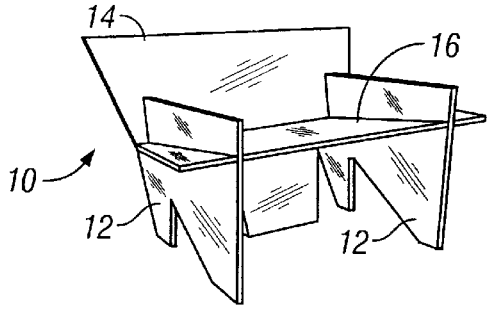
FIGS. 1*a*–1*c* are front, back and side perspective views of a ready-to-assemble article of furniture in accordance with one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 1B:
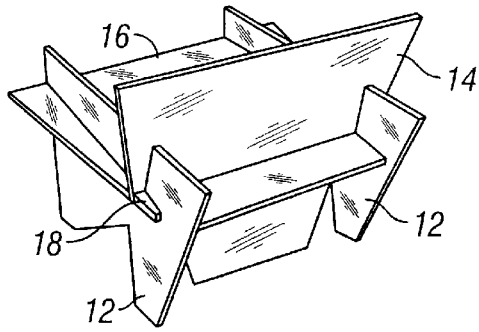
Figure 1C:
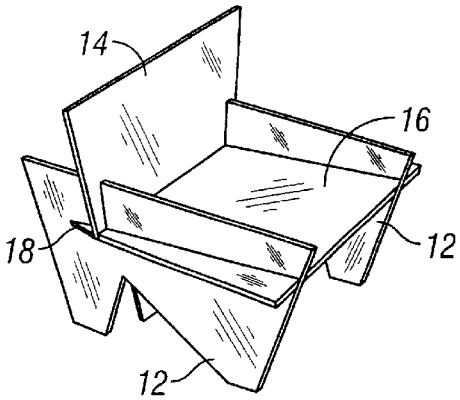

Referring to FIGS. 1*a*–1*c*, one embodiment of the ready-to-assemble article of furniture of the present invention is illustrated. In this embodiment, the furniture is a chair 10 that is formed from several components. Specifically, the chair is formed by a pair of side panels 12, a back panel 14, a base panel 16 and a pair of locking members 18. Each of the components is preferably formed of wood, either as solid wood elements or as pressed-wood or composite elements. Alternatively, the components can be formed of plastic or other suitable material. In order to maintain the ready-to-assemble attributes of the chair 10, the material of the components should be sufficiently rigid, yet light-weight to facilitate the construction of the chair. For an alternative embodiment that potentially increases the comfort of the furniture, one or more panels may be padded, for example, padded wood.

As a further feature, each of the panels can be of a different color, which can be especially appealing for use in a child's bedroom or play room, or as a unique decor element. In the case of wood panels, each panel can be painted a different color. If the panels are formed of a plastic, the plastic itself can be molded in a specific color. As explained below, a number of like panels having different colors can be offered at a retail outlet so that the consumer can select panels of the same or different colors to suit their decorating needs.

Figure 2:
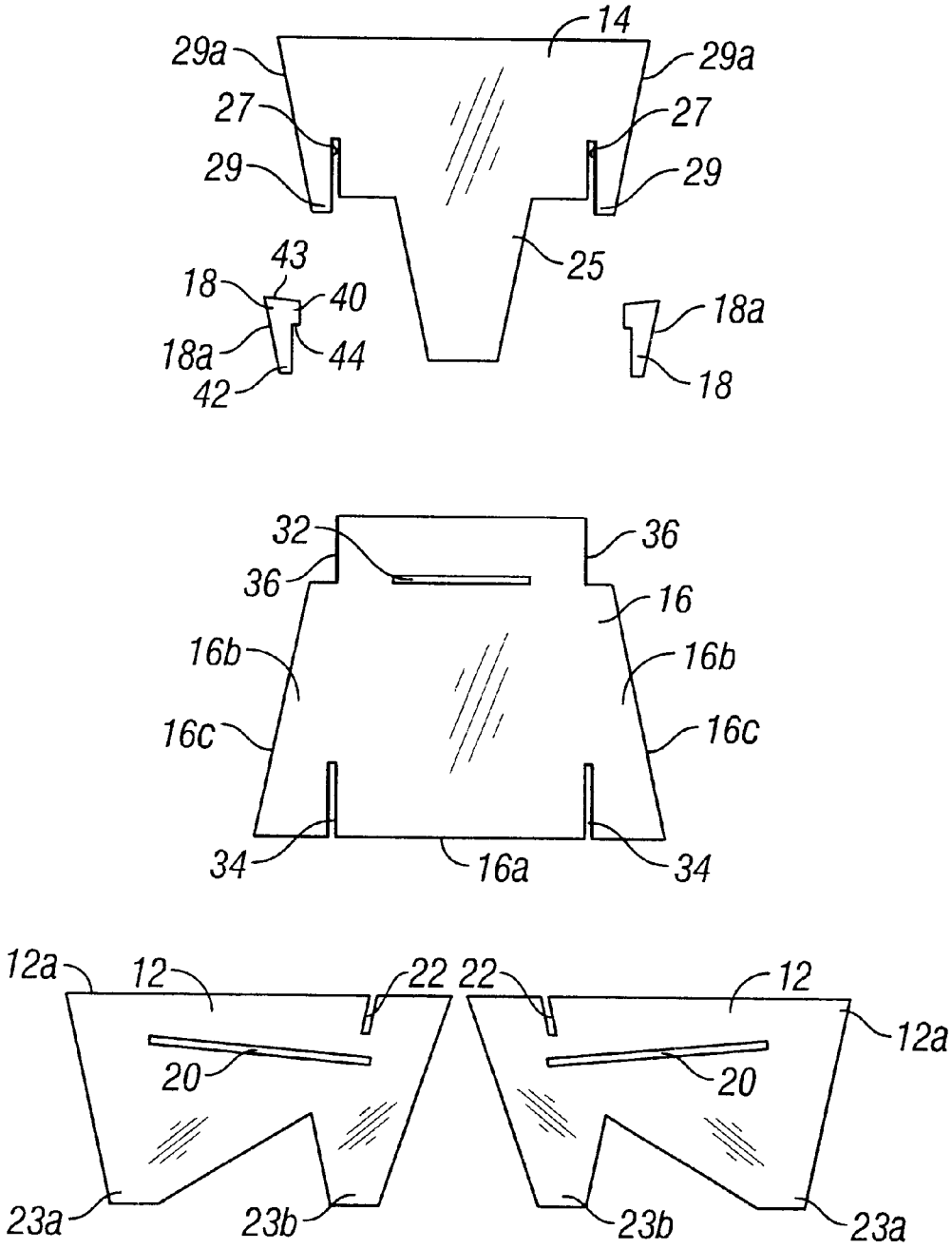
FIG. 2 is a top pattern view of the components of the RTA article of furniture illustrated in FIGS. 1*a*–1*c*.

As shown in more detail in FIG. 2, the chair components include pre-cut or pre-formed features for ornamental and functional attributes of the chair 10. For instance, the side panels 12 exhibit a generally trapezoidal configuration, and define a pair of legs 23*a*, 23*b* for supporting the article of furniture. The legs 23*a*, 23*b* must be configured to support the weight of a person sitting in the chair 10 and to resist bending as the person shifts from side-to-side in the chair. In the illustrated embodiment, the legs contact the floor along the edge of the side panels 12. Accessory components can be supplied to alter the floor contact, such as feet that can be engaged or attached to the edge of the legs.

The side panels 12 in this embodiment are identically configured, each including a closed base slot 20 and a back notch 22 formed at the top edge 12*a* of each panel. The base slot 20 is disposed within the interior of the panel 12 and can be oriented at an angle, as depicted in FIG. 2. Alternatively, the base slot 20 can run generally parallel with the lower edge of the legs 23*a*, 23*b*, so that the base will sit horizontal in the assembled article of furniture. For the purposes of the illustrated embodiment, the base slot 20 is angled to achieve a comfortable seating position in the assembled chair 10. Likewise, the back notch 22 in each side panel can extend at a non-vertical angle relative to the top edge of the panel 12, again to achieve a comfortable seating position.

The back panel 14 includes a downward leg tab 25 that serves as an additional leg for supporting the article of furniture 10. Like the legs 23*a*, 23*b*, the leg tab 25 exhibits a trapezoidal shape, adding to the overall appearance and aesthetics of the chair 10. The back panel 14 further defines a pair of side notches 27 at opposite sides of the panel. The notches 27 are sized to interlock with the back notches 22 in each of the side panels 12. The panel 14 includes locking extensions 29 that extend beyond the bottom end of the notches 27 for reasons discussed herein.

The base panel 16 defines an interior back slot 32 that is sized to receive the leg tab 25 therethrough. The slot 32 and tab 25 can be sized for a tight-fitting relationship to enhance the tightness of the assembled chair 10. The angled edges of the trapezoidal tab 25 can provide a progressive fit as the tab is passed into the slot until the edges of the tab contact the end walls of the slot 32. The base panel 16 also defines a pair of relief notches 34 at the front edge 16*a* of the panel that interlock with the ends of the slots 20 in the side panels 12. Opposite cut-outs 36 are formed at the back edge of the panel 16 to accommodate assembly of the chair 10. The relief notches 34 and cut-outs 36 define side portions 16*b* of the base panel. These side portions 16*b* are preferably configured for a tight fit through the slots 20 of the side panels 12 with the side edges 16*c* situated outboard of the side panels.

The final component of the article of furniture is the locking member 18. The member 18 includes a wedge portion 40 that is sized to slide into the slot 20. The member also defines an extension 42 that is formed by a cut-out 44 in the locking member. Again, the significance of these elements of the locking member will be understood with the following explanation of the assembly of the chair 10.

Figure 3:
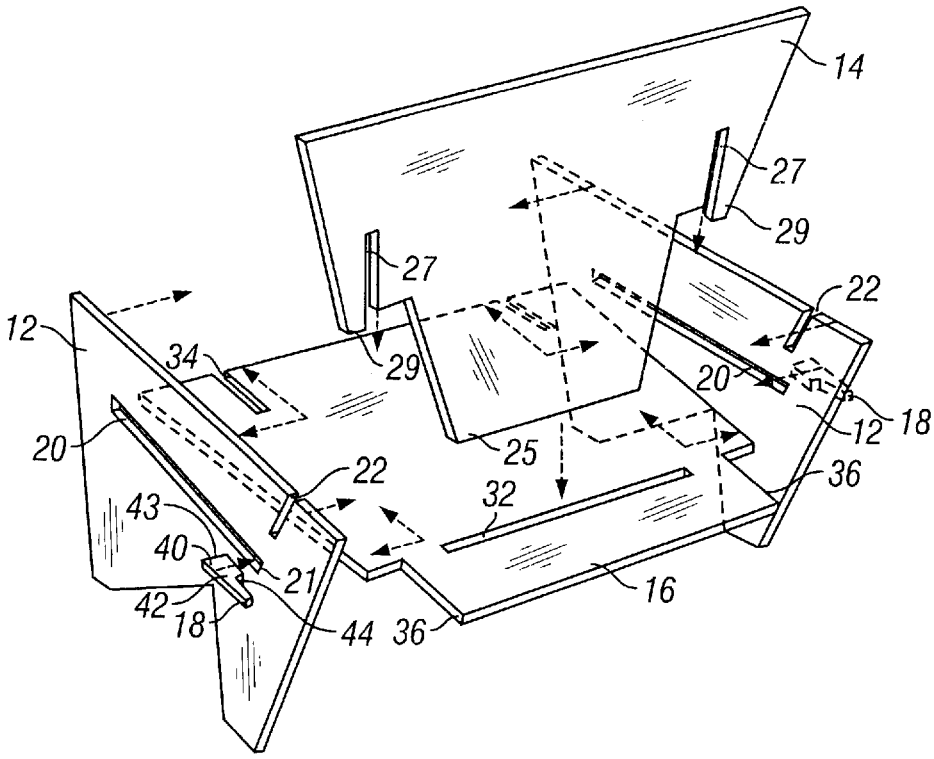
FIG. 3 is an exploded view of the components shown in FIG. 2 in an orientation for assembly of the RTA article of furniture.

This assembly of the RTA chair 10 is depicted in the exploded view of FIG. 3. The dashed arrows in the figure help illustrate the positioning and movement of each of the components to produce the final assembled chair. In a first step of the assembly process, the side panels 12 are engaged to opposite sides of the base panel 16. Specifically, the side portion 16*b* at one side of the base panel is passed into the base slot 20 until the cut-out 36 contacts the inside surface of the side panel. The base panel 16 is then moved forward within the slot 20 so that the relief notch 34 is interlocked with the end wall of the slot. In this position, the front edge of the base panel 16 will be oriented generally flush with the front edge of the side panel 12. The process is repeated for the side panel 12 on the other side of the chair.

With this construction, the side portions 16*b* thus project outward from the side panels 12. In the illustrated embodiment, these side portions are angled to provide a decorative effect. However, in alternative embodiments, parts of the side portions 16*b* can be wider, or project farther outward from the side panels when the chair is constructed. These extended side portions 16*b* can provide a stable support surface immediately adjacent the chair or other article of furniture on which food, drink, decorative items or literature may be placed.

Next, the leg tab 25 of the back panel 14 is slid as far as possible into the back slot 32 in the base panel 16. At the same time, the side notches 27 are simultaneously slid into the back notches 22 in the side panels 12. The notches 27 and 22 interlock and overlap so that the locking extension 29 passes across the slot 20, as seen best in the enlarged view of FIG. 4 or in FIG. 1*b* or 1*c*. Since the base panel 16 has been pushed forward within the slot 20, the locking extension 29 will contact a part of the cut-out 36 of the back panel 14, helping to hold the base panel, in this position.

In order to lock the RTA components together, the locking member 18 is pushed into a back portion 21 of the slot 20. More specifically, the wedge portion 40 is pushed into the slot with the angled edge 43 bearing against the locking extension 29 and the cut-out 44 bearing against the end of the slot 20. The angled edge 43 provides a variable contact and locking surface—i.e., the wedge portion 40 is pushed as far as possible into the slot 20 until the cut-out 44 and angled edge 43 are wedged between the locking extension 29 and back portion 21 of the slot 20.

Figure 4:
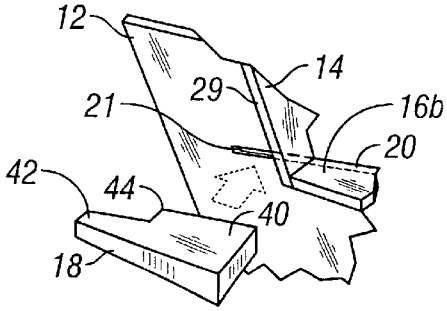
FIG. 4 is an enlarged perspective view of a locking component of the RTA article of furniture of the illustrated embodiment.

As shown in the enlarged view of FIG. 4, the wedge portion 40 bears against the locking extension 29, which bears against the base panel 20 to wedge the panel into the slot 20. It can be appreciated that the angled edge 43 allows periodic tightening of the wedge fixation by simply pushing the wedge portion 40 further into the slot 20. Optimally, the locking member 18 will be lodged within the slot so that the edge 18*a* at the extension 42 is generally flush with the side edge 16*c* of the base portion 16 and the edge 29*a* of the back portion 14 to yield a finished appearance.

The construction of the components of the chair 10 can be firmly inter-engaged to establish a solid seating surface. One feature of the invention is that the length of the notches is kept to a minimum. One problem with prior knock-down furniture is that the interlocking notches extend across a substantial portion of the length or width of a furniture component. The notches are an inherent weakness in any interlocking construction of this type, so the point of failure of prior knock-down furniture was frequently at the notches. The present invention has acknowledged this problem by keeping the length of the notches to a minimum. Moreover, at the point of the greatest load—the clamping component—the clamping function is not achieved by interlocking notches-but instead by a wedging action between panel surfaces.

In additional to the novel interlocking construction, the present invention contemplates a furniture system that can be quickly and easily converted between different articles of furniture. In the illustrated embodiment, the side panels 12 are identically configured so that they can be readily used on either side of the article of RTA furniture. Alternatively, the panels can be mirror configured, or provided in mirror-configured pairs, where the outboard surface has a different finish than the inboard surface of the side panels. This alternative configuration reduces the universality of the side panels, but allows for a custom outboard finish. (Note: for the purposes of the present disclosure, it is assumed that "identically configured" encompasses "mirror configured" in reference to the RTA furniture panels. Moreover, the identical or mirror configuration refers primarily to the interlocking elements of the panels. Thus, opposite side panels can have different contours, provided that the interlocking elements, such as the slot 20, notch 22 and ground-engaging elements follow the identical configuration theme).

Figure 5:
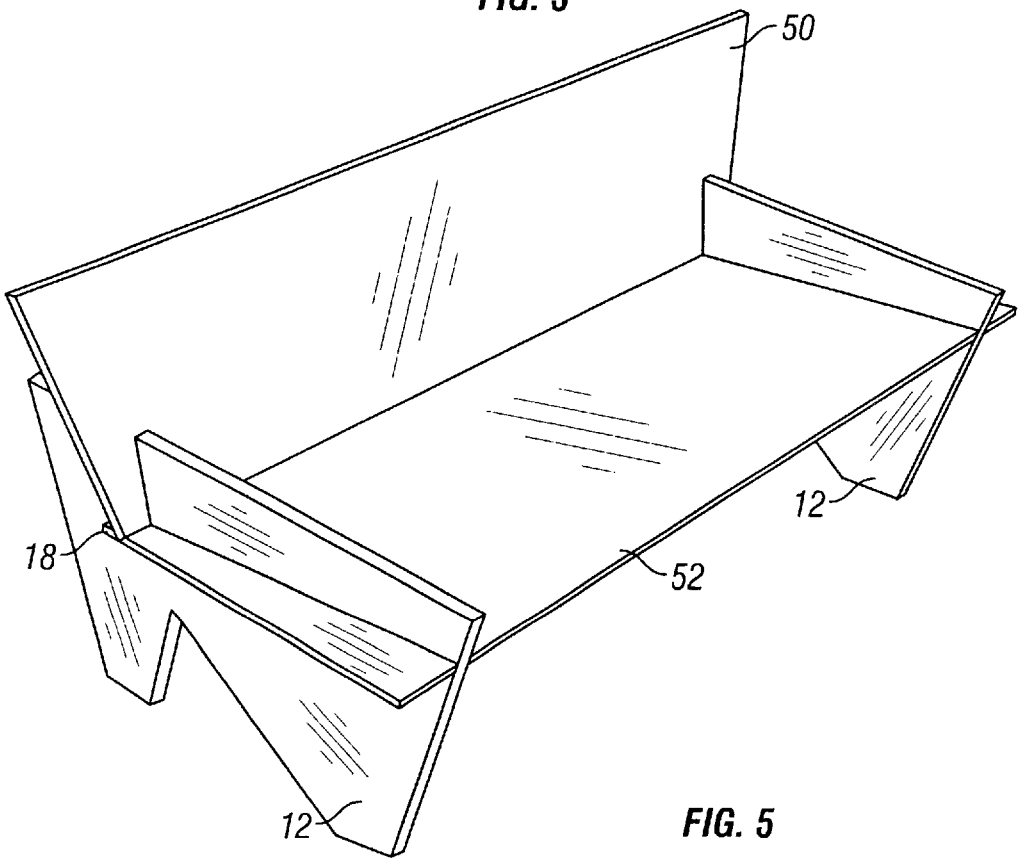
FIG. 5 is a front perspective view of a sofa rendition of the RTA article of furniture in accordance with a further embodiment of the invention.

In accordance with one aspect of the invention, the side panels 12 and locking members 18 can be common to a wide variety of articles of furniture. As shown in FIGS. 1*a*–1*c*, a chair 10 is formed by combining the side panels with "chair configured" back and base panels 14, 16. The love seat shown in FIG. 5 can be created using the same side panels 12 and locking members 18 by simply substituting longer back and base panels 50, 52, respectively. The panels can be constructed to their counterpart panels 14, 16 to form the same interlocking construction with the side panels.

Figure 6:
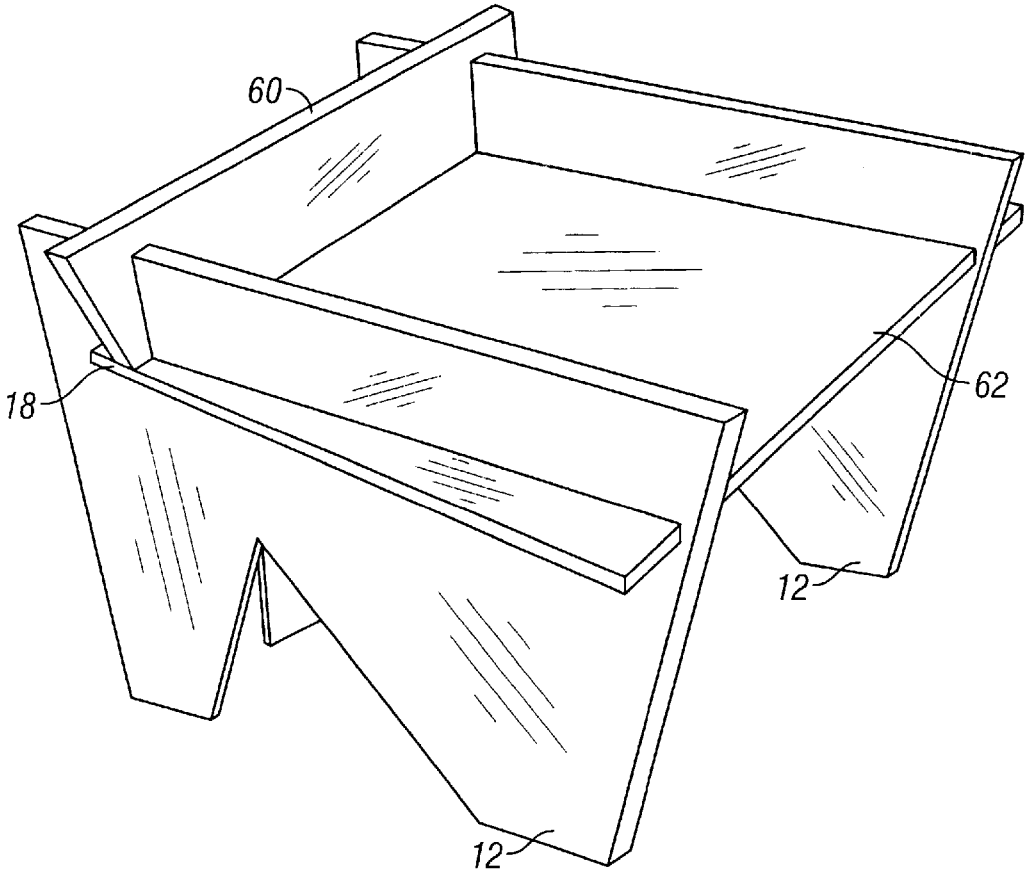
FIG. 6 is a front perspective view of a table or ottoman rendition of the RTA article of furniture in accordance with a further embodiment of the invention.

In a similar manner, a table or ottoman shown in FIG. 6 can be produced by a back panel 60 that is vertically shorter than the back panel 14 of the chair 10. A base panel 62 can be utilized to form the table or ottoman. Preferably, the base panel 62 is identical to the base panel 16, so that only the back panel need be substituted.

Figure 7:
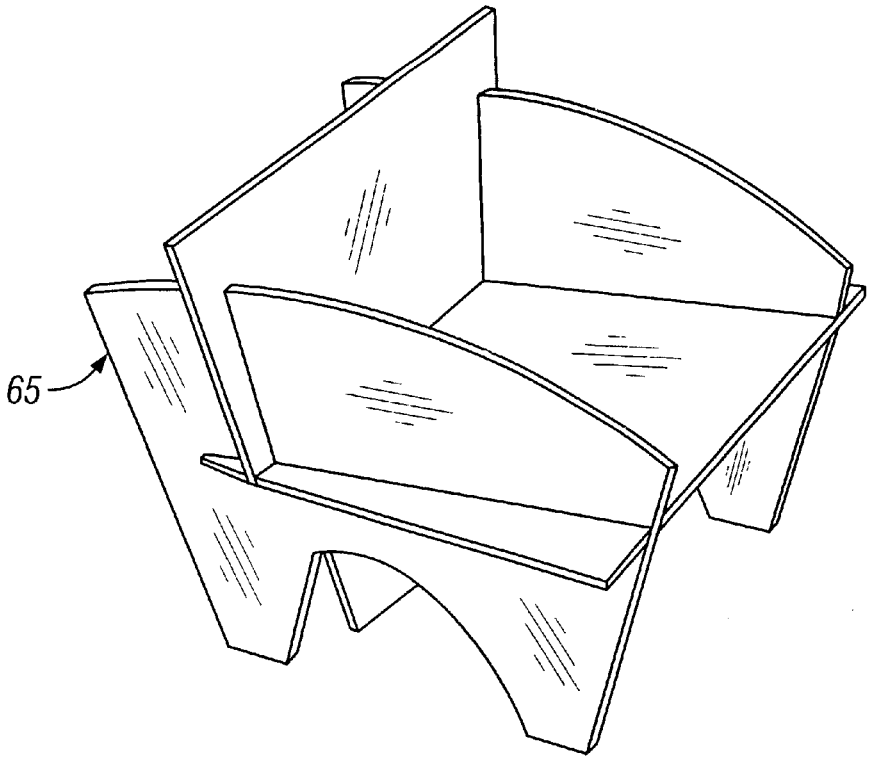
FIG. 7 is a perspective view of an alternative embodiment of a chair rendition the RTA article of furniture in accordance with the invention.
Figure 8:
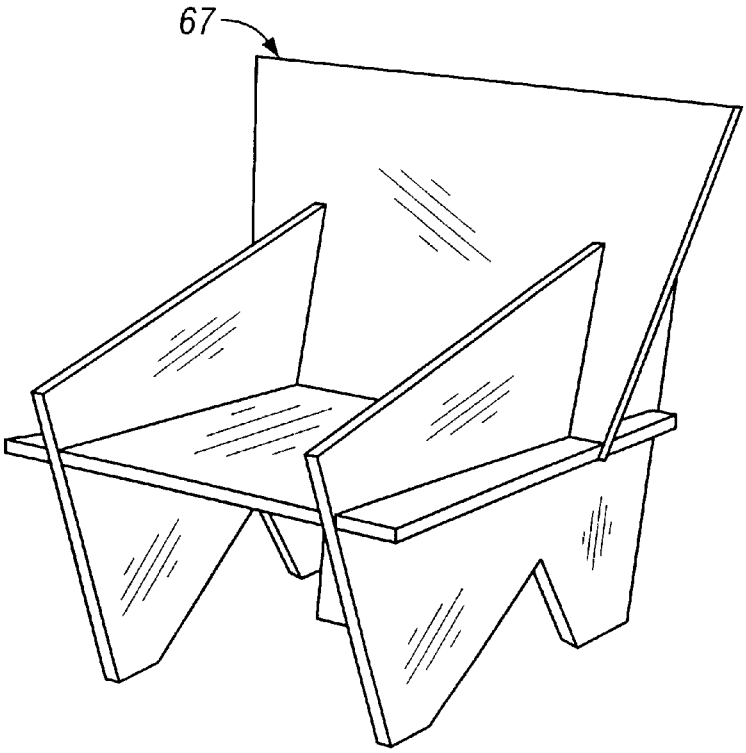
FIG. 8 is a perspective view of an angular chair rendition of the RTA article of furniture accordance with the invention.

In addition to permitting easy conversion between articles of furniture, the RTA furniture of the present invention allows easy mixing and matching of panel colors and designs. For instance, a chair, such as chair 10, can be more aesthetically pleasing to a child if each of the panels is in a different color. Thus, one can maintain a supply of panels 12, 14, and 16 of different colors to change the appearance of the article of furniture as desired. Moreover, the panels can have different profiles to alter the overall aesthetic effect of the furniture. For example, the furniture shown in the present figures follow a generally angular or trapezoidal profile. Alternatively, the corners of the panels or even the panels themselves can be rounded and the legs 23*a*, 23*b* can be modified or combined according to taste. The chairs 65 and 67 shown in FIGS. 7 and 8 illustrate the variability in configuration and appearance that can be achieved with the RTA system of the present invention. Again, as with the differently colored panels, one can maintain an inventory of panels with different profiles to permit ready modification of an article of furniture. In addition to different profiles and colors, the panels can carry different indicia or surface patterns.

Figure 9A:
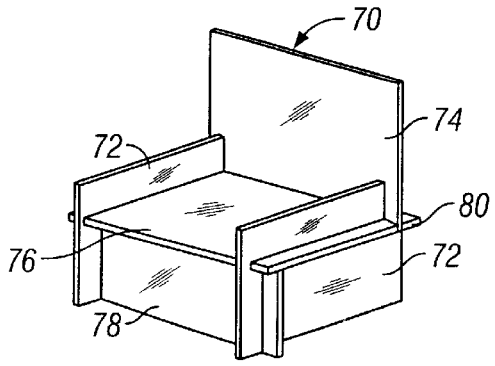
FIGS. 9*a*–*d* are perspective, side partial cross-section, top and front views of a formal chair embodiment of the RTA furniture of the present invention.
Figure 9B:
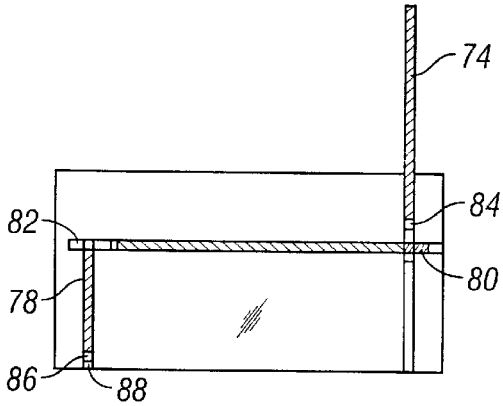
Figure 9C:
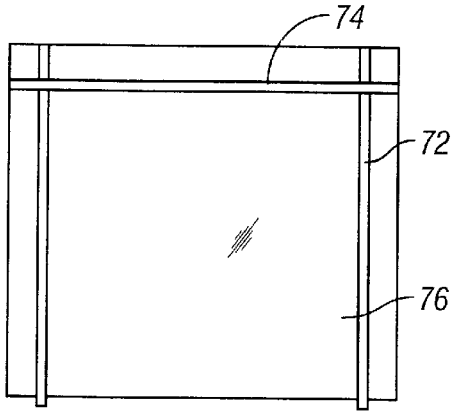
Figure 9D:
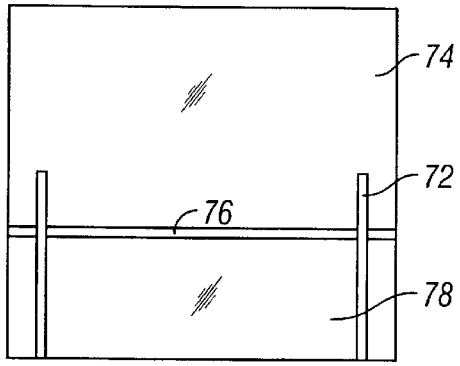
Figure 10A:
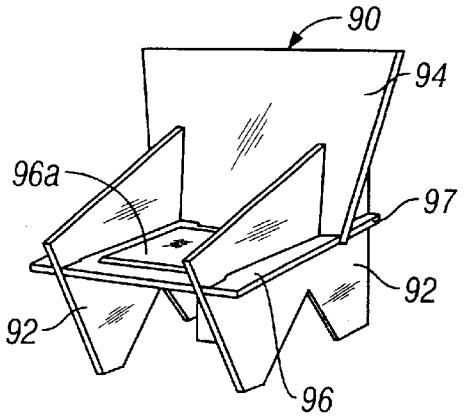
FIGS. 10*a*–*d* are perspective, side, top and front views of a padded chair embodiment of the RTA furniture of the present invention.
Figure 10B:
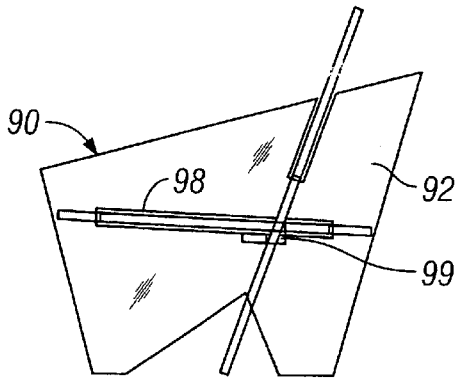
Figure 10C:
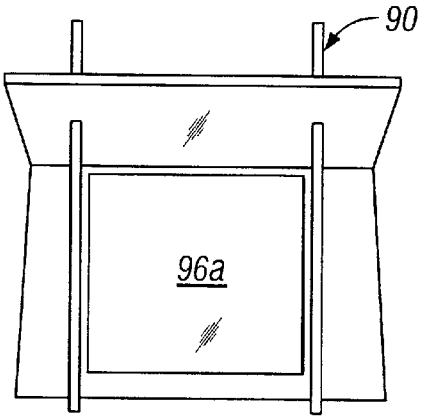
Figure 10D:
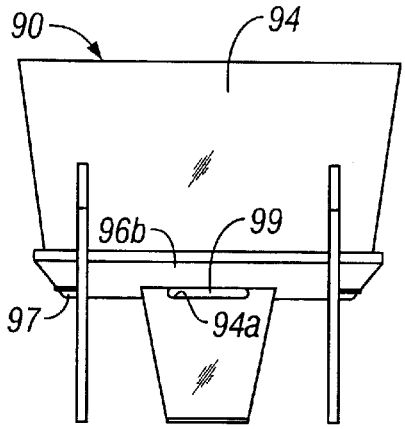

A low-rise chair 70 shown in perspective in FIG. 9*a* further demonstrates the flexibility of the RTA system of the present invention. The chair is shown in side partial cross-section view in FIG. 9*b*, in top view in FIG. 9*c* and in front view in FIG. 9*d*. This chair 70 includes opposite side panels 72, a back panel 74 and a base panel 76, as with the chairs in the prior figures. The chair 70 also relies upon the wedge locking member 80 to provide the final tightening of the complete chair assembly. However, the chair adds a front panel 78 that essentially closes the front face of the chair.

The side panels 72, back panel 74 and base panels 76 can include the same array of slots and notches as with the chair 10 illustrated in FIGS. 1–3. In order to accommodate the front panel, the side panels require some modification. As shown best in FIG. 9*b*, the side panel includes a base slot 82 for receiving the base panel 76 and the locking member 80. A generally vertical back notch 22 engages the back panel 74. In a modification from the prior described chair, the side panels 72 also include a front panel slot 86 that intersects the base slot 82. The front panel slot 86 is slightly longer than the height of the front panel 78. The front panel includes its own notch 88 to engage the base of the slot 86 to lock the panel when the base panel 76 is disposed within the base slot 82. Again, the wedge locking member 80 locks the entire ready-to-assemble low-rise chair 70 together.

This versatility not only improves a consumer's furniture options, it also presents a unique method of selling furniture. In one embodiment, the RTA furniture of the present invention can be sold pre-packaged with all the components for a specific article of furniture in one box. Auxiliary components can be sold separately, such as different back panels or base panels. In one approach, back and base panel pairs can be sold together. For instance, a chair conversion kit can have back and base panels of one length, while a sofa conversion kit can include back and base panels of a greater length.

In another embodiment, the components can be sold individually to allow the consumer unlimited choices for the RTA furniture. The components can have a variety of sizes, colors, profiles and surface patterns that can be mixed and matched at will by the purchaser.

The RTA furniture concept of the present invention can be constructed without the puzzle-like complexity of prior knock-down furniture approaches. Moreover, each of the articles of furniture embodying this invention require only four panels and two locking members to provide a fullyfunctional, solidly built structure. This simple construction allows a consumer to quickly replace a damaged component, or change out components for a different decorating effect.

The wedge portion of the locking member provides a solid, yet adjustable, clamping of the furniture panels. The wedging feature of this invention relies upon surface-to-surface pressure contact between components to achieve a solid fixation. Moreover, the locking member operates and locks all three panels at a side so that all panels are, in effect, inter-engaged with each other. This feature provides a significantly more rigid construction than prior knock-down items in which the locking feature is limited to less than all of the furniture components. Man of those ill-fated prior items relied instead upon loosely interlocking certain components, while locking a couple of key components to prevent disengagement of the other components. This approach allowed a great deal of slop or movement between interlocked components, a problem that is not suffered by RTA furniture constructed according to the present invention.

While the locking member of this invention produces a solid furniture construction, it also makes disassembly of the furniture very easy. The furniture components can be separated by simply dislodging the wedge portion 43 of the locking member 18 from the slot 20. This can be accomplished by manipulating the extension 42 of the member 18 until the wedge portion is loosened. Since the locking member is configured to follow the contour of the base panel, it is not susceptible to accidental dislodgement.

In an alternative embodiment of the locking member 18, a torsion spring or other spring action device, not shown, may be used further secure the member 18 within the slot 20. To this-end the spring action device may for example include a countersunk torsion spring that is disposed within a countersink opening in the cut-out 44. When the member 18 is within the slot 20, the spring action device would tend to force the member 18 against the edge of the seat 16 to further secure the member 18 in place. It may be advisable to reduce the sloping aspect of surface 43 in such an embodiment. Other spring-loaded configurations may also be employed. The use of spring loading may increase the ability to retain: structural integrity after the wood ages for a significant time.

Accordingly, the present invention provides an RTA furniture article, as well as an RTA furniture system, that incorporates style, convenience, and can be produced, stored, shipped and manufactured relatively inexpensively. At least some of the structure features may be carried over into other RTA interior design elements, such as, but not limited to, bookshelves, plant stands, magazine racks, office partitions (cubicles), lighting, sculpture. Depending on the proper selection of materials, the RTA furniture of the present invention is suitable for outdoor use as well as indoor use.

The RTA furniture system of the present invention also contemplates a padded chair 90 as part of the furniture line. This chair 90 is depicted in perspective, side, top and front views in FIGS. 10*a*–10*d*, respectively. As with the prior wedge-locked chair 10, the chair 90 includes side panels 92, back panel 94, base panel 96 and wedge locking member 97. However, the base panel 96 includes a padded portion 96*a* that can be affixed to or integrated into the base panel 96. In order to accommodate the thicker padded portion 96*a*, the base slot 98 in the side panels 92 is thicker than the base panel itself and thick enough to allow the padded portion to pass therethrough.

Figure 11:
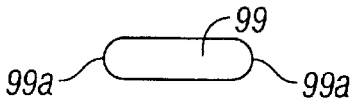
FIG. 11 is a top elevational view of a locking member for use with the chair shown in FIGS. 10*a*–*d*.

The padded chair 90 also illustrates another feature of the RTA furniture system of the present invention. Since the padded base panel requires a wider base slot 98, a degree of "slop" is present in the positioning of the base panel. In order to eliminate this "slop", the present invention contemplates a base locking member 99 that bears against the underside 96*b* of the base panel. More specifically, the base locking member can be configured as shown in FIG. 11. The locking member 99 can be generally elongate and oval in configuration, having rounded ends 99*a*. The locking member 99 is slightly shorter than the length of a slot 94*a* formed in the back panel 94. The slot 94*a* is arranged on the panel to be situated directly adjacent the underside 96*b* of the base panel 96 when the chair is assembled. The base locking member 99 can be pressed into the slot 94*a* so that the member bears against the base panel 96 and provides a slight upward force against the panel to push it against the upper edge of the base slot 98 in the side panels. The wedge locking members 97 can then be pressed into position to lock the entire assembly together.

Figure 12A:
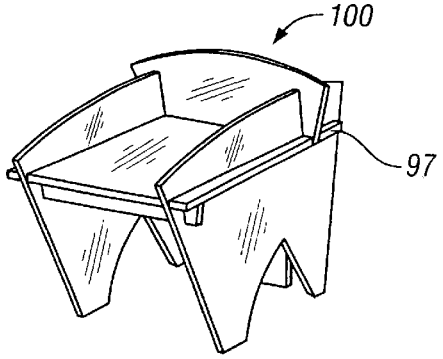
FIGS. 12*a*–*c* are perspective, side partial cross-section, and front views of a rounded chair embodiment of the RTA furniture of the present invention.
Figure 12B:
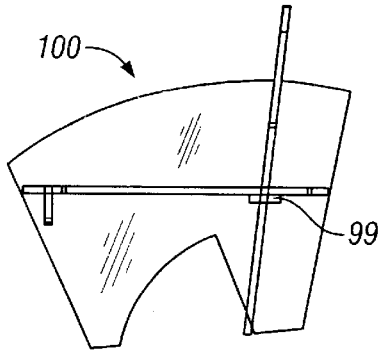
Figure 12C:
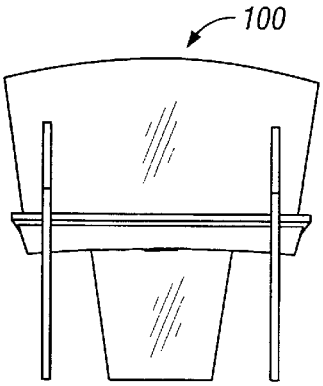
Figure 14A:
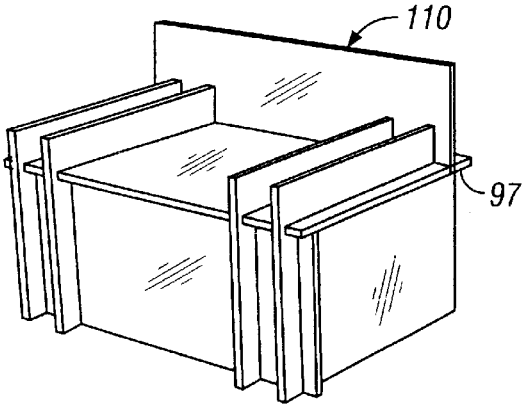
FIGS. 14*a*–*b* are perspective and side views of a thick chair embodiment of the RTA furniture of the present invention.
Figure 14B:
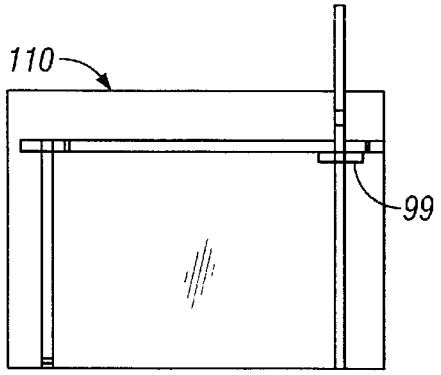
Figure 15A:
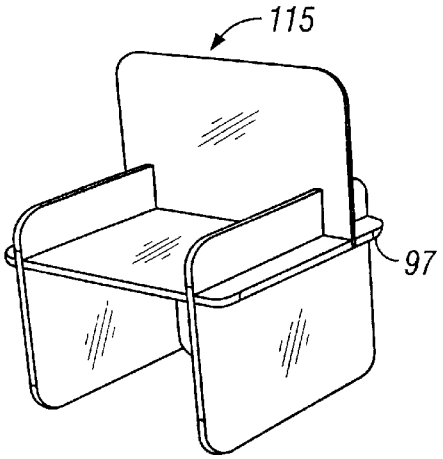
FIGS. 15*a*–*b* are perspective and side views of a traditional chair embodiment of the RTA furniture of the present invention.
Figure 15B:
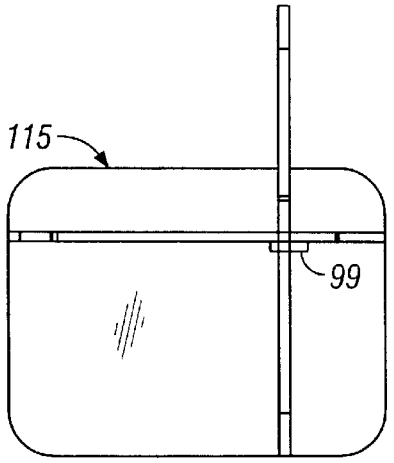
Figure 16A:
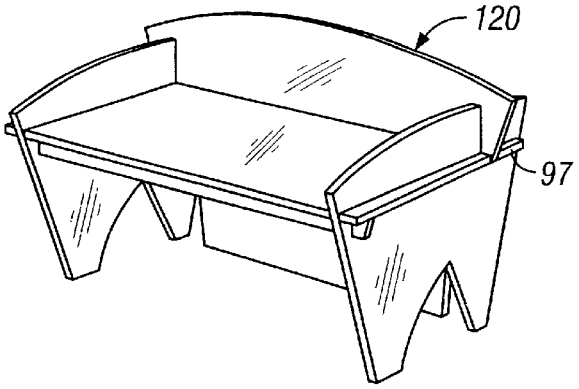
FIGS. 16*a*–*d* are perspective, side, top and front views of a love seat or bench embodiment of the RTA furniture of the present invention.
Figure 16B:
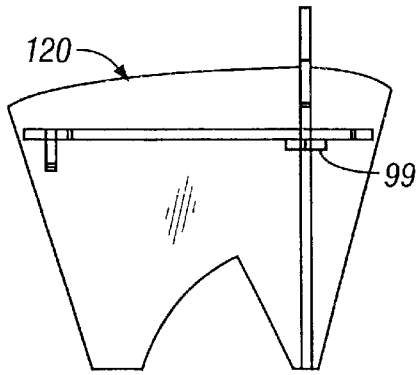
Figure 16C:
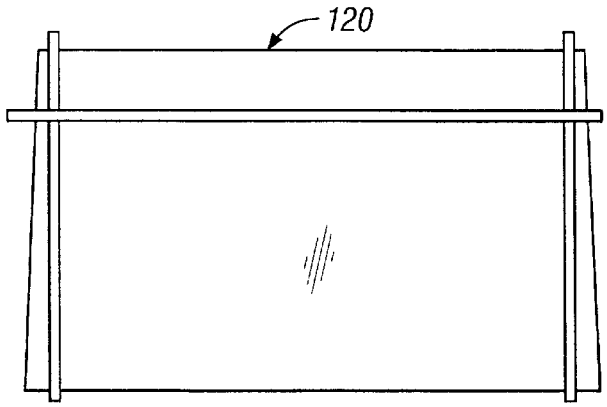
Figure 16D:
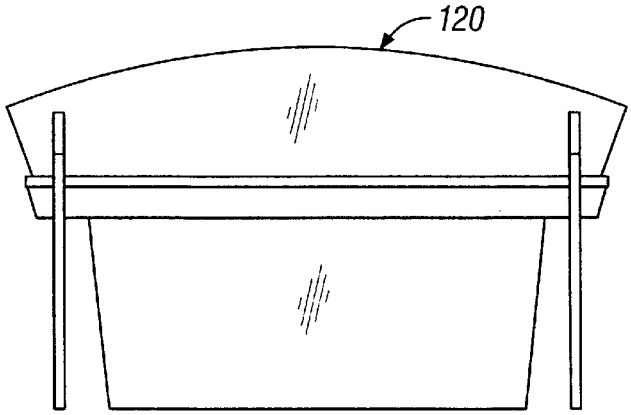
Figure 17A:
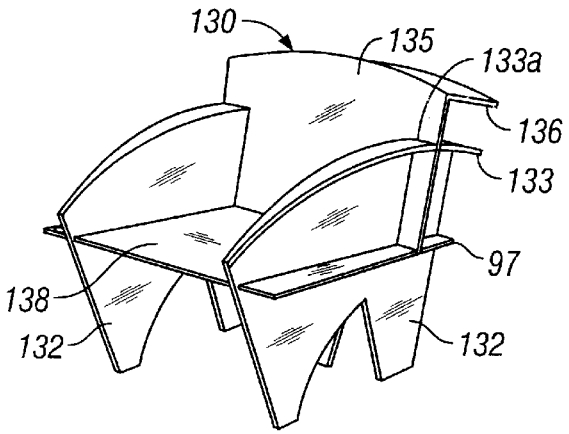
FIGS. 17*a*–*d* are perspective, side, top and front views of a beach chair embodiment of the RTA furniture of the present invention.
Figure 17B:
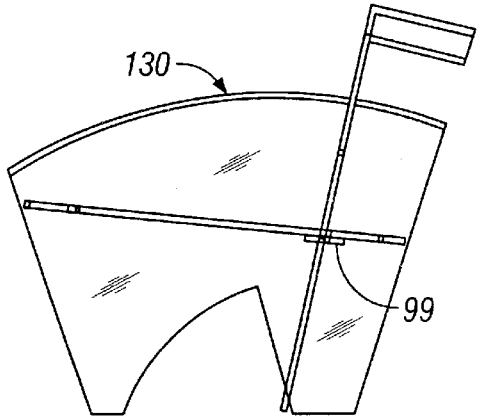
Figure 17C:
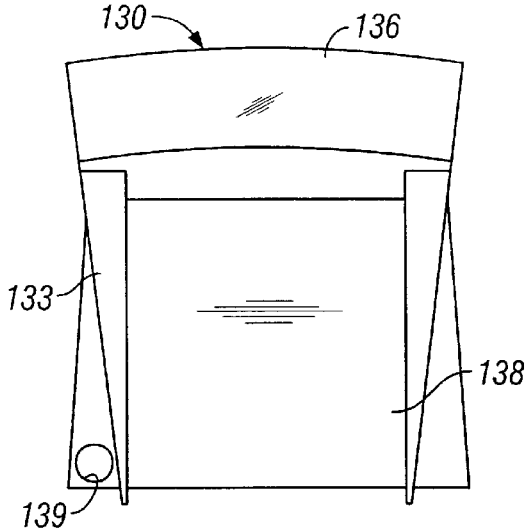
Figure 17D:
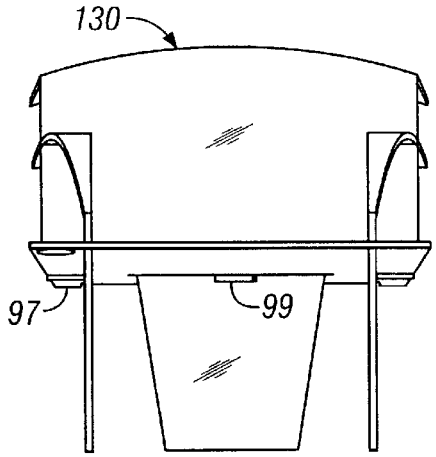

This same combination of wedge locking member 97 and base panel locking member 99 can be implemented in a wide range of furniture items. A rounded chair is depicted in FIGS. 12*a–c*, and asymmetric chair in FIGS. 13*a–b*, a wide chair in FIGS. 14*a–b* and a traditional chair in FIGS. 15*a–b*. The same principals can be applied to longer furniture, such as the love seat/bench of FIGS. 16*a–d*.

As described above, the RTA furniture of the present invention can be formed of plastic. A plastic beach chair according to one embodiment of the invention is depicted in FIGS. 17*a–d*. The beach chair 130 includes side panels 132 that incorporate a stiffening flange 133 at the upper edge of each panel. The flange 133 is preferably wide enough to double as an armrest. The flange 133 defines a notch 133*a* to receive the back panel 135. The back panel 135 also includes a stiffening flange 136 projecting to the rear of the chair 130. The stiffening flanges add rigidity to the panels to resist bending or bowing of the panels when a consumer is sitting in the chair.

The beach chair 130 also includes a base panel 138 that is held within the chair by the wedge locking member 97 and base locking member 99 as described above. In certain embodiments, the base panel 138 can include a drink holder 139 formed in the plastic material on one or both sides of the chair.

Figure 18A:
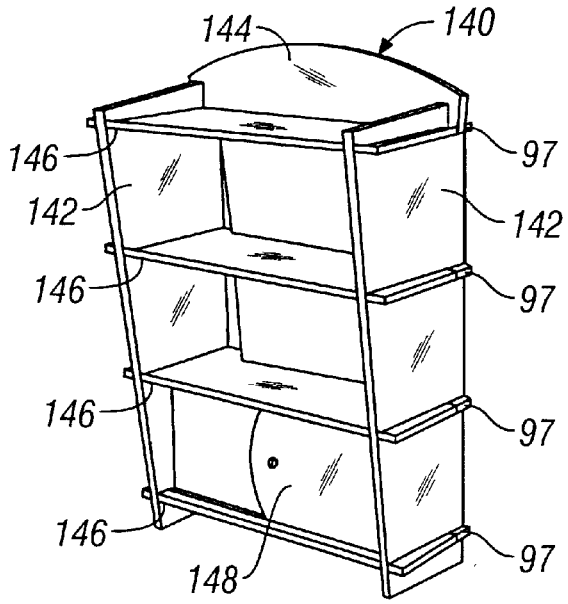
FIGS. 18*a*–*d* are perspective, side, top and front views of a bookshelf embodiment of the RTA furniture of the present invention.
Figure 18B:
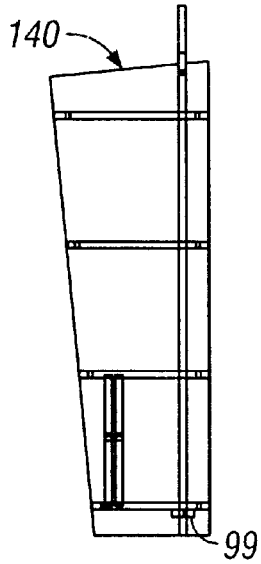
Figure 18C:
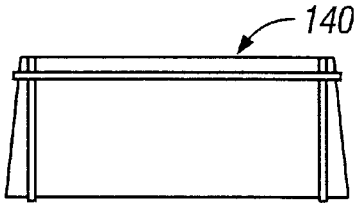
Figure 18D:
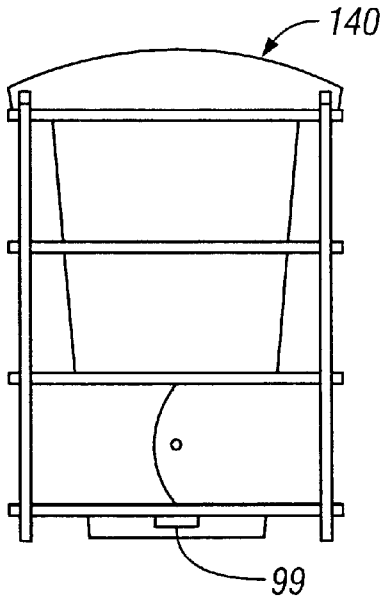

Thus far, the furniture items describe above that use the wedge locking member 18, 97 alone or in conjunction with the base locking member 99 have been seating items. However, these same concepts can be applied to other types of furniture. For instance, a book shelf 140 is shown in FIG. 18*a*, and in the side, top, and front views of FIGS. 18*b–d*. The book shelf 140 includes opposite side panels 142 and a back panel 144. The back panel is shown tapered from top to bottom for a decorative effect; however, the panel can span the entire width of the book shelf according to taste.

The book shelf 140 also includes a number of shelf panels 146. Each shelf panel is connected to the side panels and back panel using the same type of slots and notches implemented with the chair 10, for instance. In addition, each shelf panel 146 can be held in place, and the entire RTA assembly locked together using a plurality of wedge locking members 97. It can be noted that only the top-most wedge locking member 97 bears against the back panel 144 in the manner describe above. The lower locking members only wedge against the corresponding shelf panel, since the back panel does not project through an associated vertical slot in the side panel.

In the illustrated embodiment, the lowermost shelf panel is maintained by a base locking member 99, again in the manner described above. Alternatively, each shelf panel can include a corresponding base locking member 99 to provide additional vertical support and load-bearing capability. One or more of the shelf panels can be configured to support sliding doors 148 as shown in FIGS. 18*a,d*.

Figure 19:
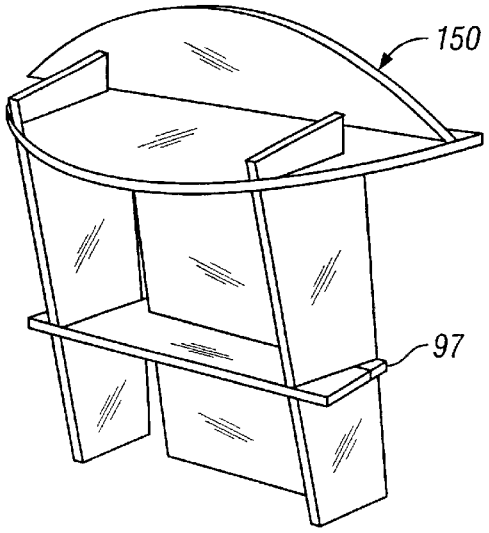
FIG. 19 is a perspective view of a sofa table embodiment of the RTA furniture of the present invention.
Figure 20A:
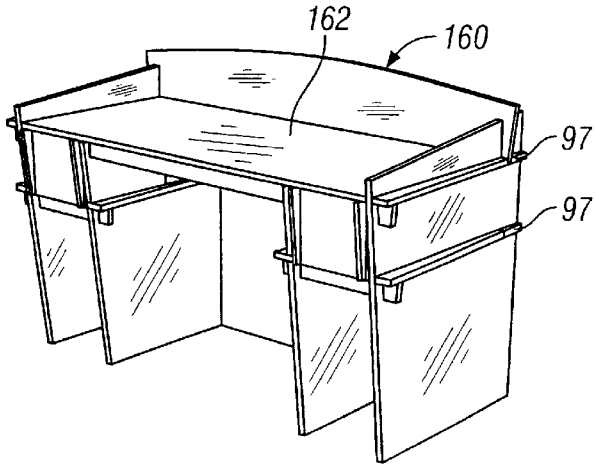
FIGS. 20*a*–*c* are perspective, side, and front views of a desk embodiment of the RTA furniture of the present invention.
Figure 20B:
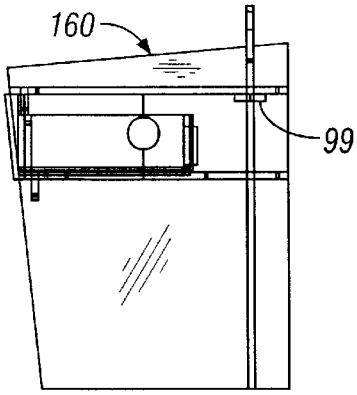
Figure 20C:
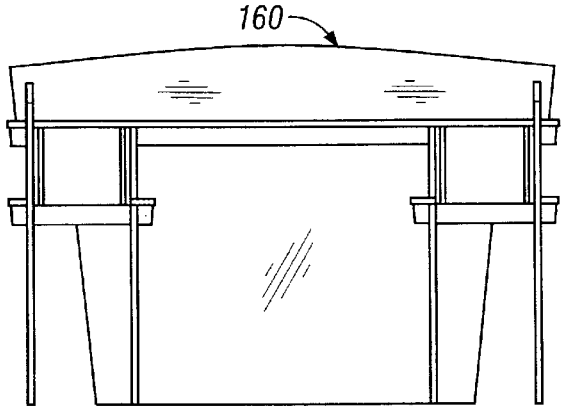
Figure 21:
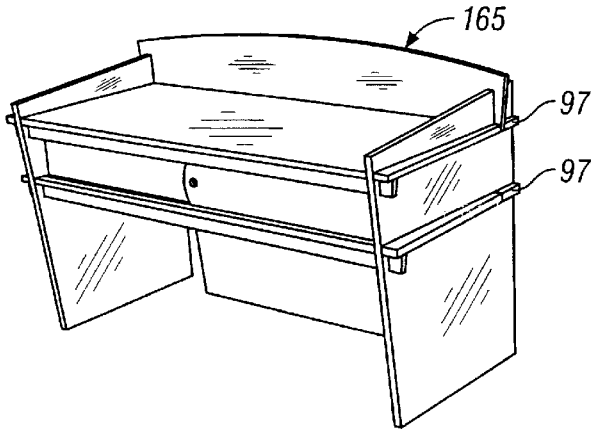
FIG. 21 is a perspective view of a server or buffet embodiment of the RTA furniture of the present invention.

The same concepts implemented to form the RTA book shelf can be used to form a sofa table, such as the table 150 shown in FIG. 19. The construction and assembly of this table is similar to the book shelf. Likewise, the same principals can be applied to create a desk 160, shown in FIGS. 20*a–c*, or a server/buffet, as shown in FIG. 21. Both furniture items utilize both the wedge locking member 97and the base locking member 99, with the latter locking member used to support the table top, such as desk top 162.

Figure 22A:
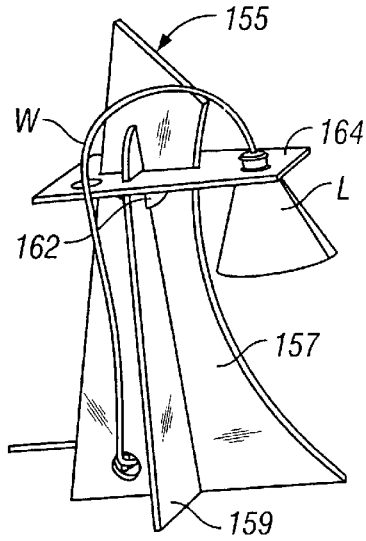
FIGS. 22*a*–*d* are perspective, front, side and top views of a lamp embodiment of the RTA furniture of the present invention.
Figure 22B:
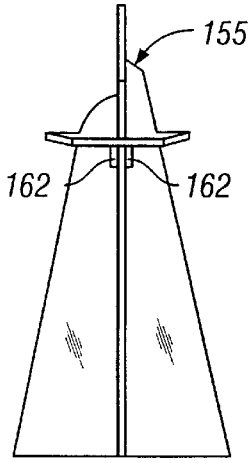
Figure 22C:
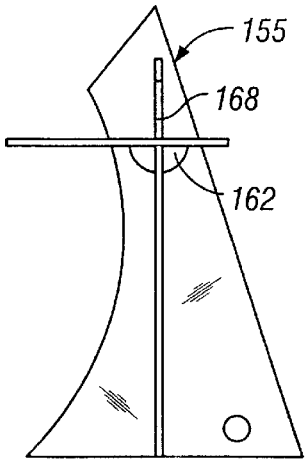
Figure 22D:
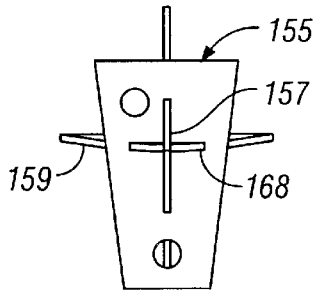

The locking members described above can also be used on smaller decorative or furniture accessory items. For instance, the present invention contemplates a lamp assembly 155, as shown in FIGS. 22*a–d*. The lamp assembly supports a lamp L and its wiring W, as shown in FIG. 22*a*. The assembly 155 includes a vertical panel 157 that defines a vertical slot 158 extending along a substantial portion of its length. The slot is configured to receive a transverse panel 159 that defines a mating notch 161 at its bottom edge. At the top edge of the transverse panel 159 are a pair of spaced-apart notches 160 that straddle the vertical panel 157 when the transverse panel is situated within the slot 158.

The notches 160 are configured to receive a pair of support members 162. The support members 162 preferably form a flat surface to support a top plate 164 that is connected to the top of the vertical panel. In particular, the top plate 164 defines a slot 165 through which the top of the vertical panel 157 extends. The top plate can define a wiring hole 166 and a lamp hole 167 for supporting those respective components of the lamp. The entire assembly is held together by a wedge locking member 168 that fits through the upper portion of the vertical slot 158 in the vertical panel 157. The wedge locking member bears against the top surface of the top plate 164 to push the panel against the support members 162.

Figure 23A:
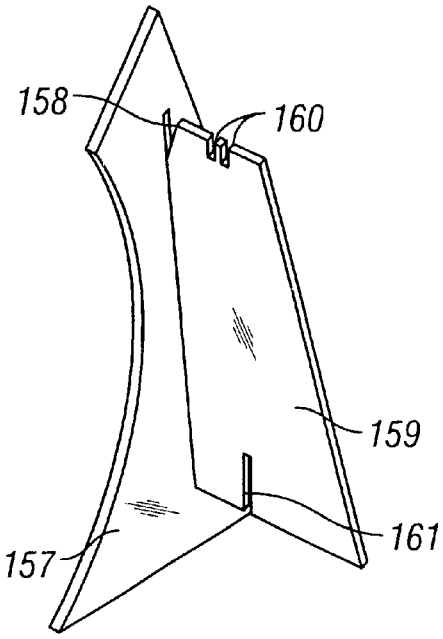
FIGS 23*a*–*d* illustrate steps for assembling the lamp shown in FIG. 22*a*.
Figure 23B:
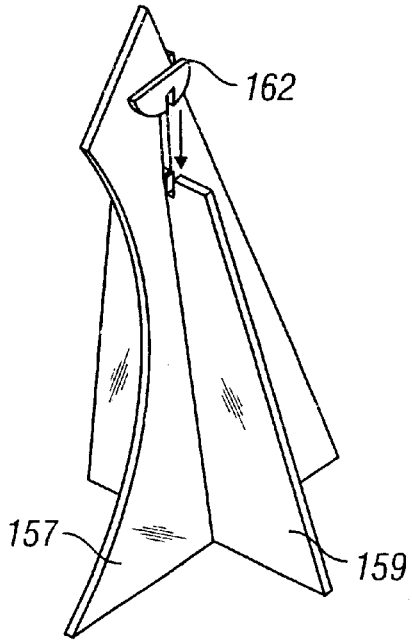
Figure 23C:
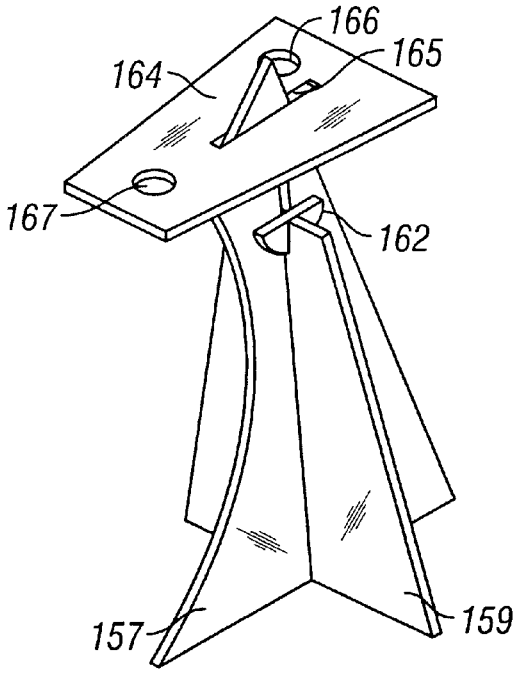
Figure 23D:
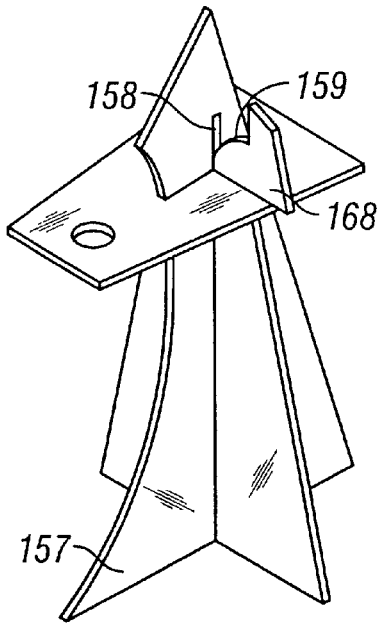
Figure 24A:
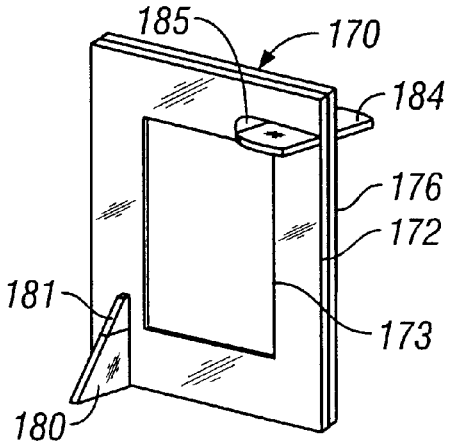
FIGS. 24*a*–*d* are perspective, front, side and top views of a lamp embodiment of the RTA furniture of the present invention.
Figure 24B:
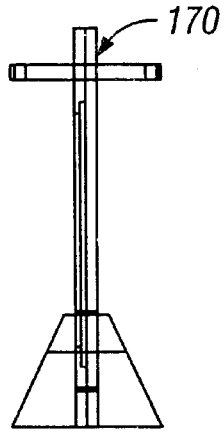
Figure 24C:
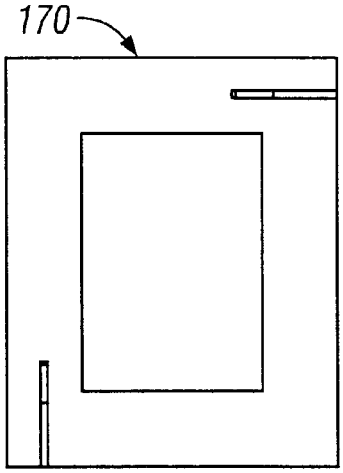
Figure 24D:
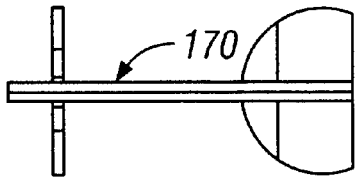

The construction of the lamp assembly proceeds according to the steps shown in FIGS. 23*a–d*. In the first step, the transverse panel 159 is mated with the vertical panel 157. The support members 162 are added in the next step of FIG. 23*b* and the top plate mounted over the vertical panel, as shown in FIG. 23*c*. In the final, step, the wedge locking member 168 is pushed into the top of the vertical slot 158 The locking member 168 preferably includes a curved edge 159 to provide a camming effect as the member is pushed further into the slot. The locking member presses the top plate against the support members to firmly lock the lamp assembly 150 together.

The invention also contemplates a picture frame that utilizes the wedge locking member to complete its construction. As shown in FIGS. 24*a–d* and the assembly drawings of FIGS. 25*a–d*, the picture frame 170 includes a front panel 172 that defines a picture opening 173, along with a vertical slot 173 and a horizontal slot 175. A complementary shaped backing panel 176 also defines coincident vertical and horizontal slots 177, 178, respectively. The front panel 172 need not include a separate opening 173 provided that the panel is formed of a material through which a picture is visible. For instance, the front panel 172 can be formed of a clear thermoplastic to provide an entirely transparent face.

Figure 25A:
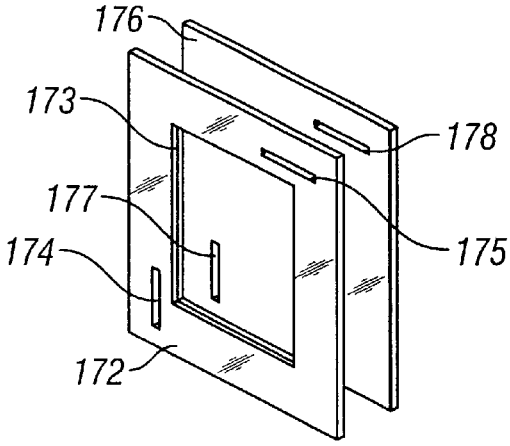
FIGS. 25*a*–*d* illustrate steps for assembling the lamp shown in FIG. 24*a*.
Figure 25B:
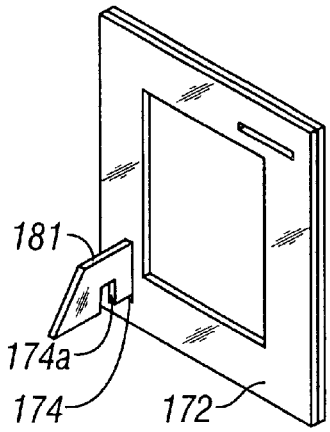
Figure 25C:
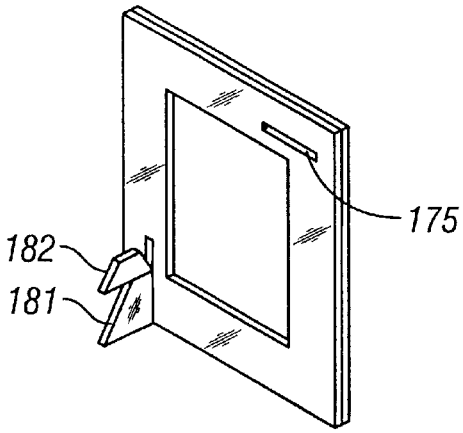
Figure 25D:
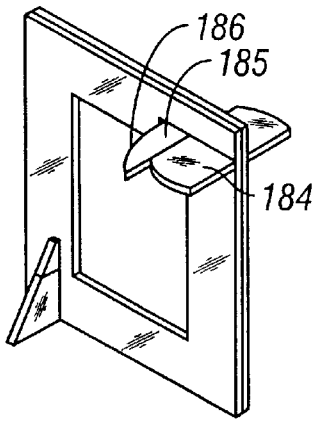

The two frame panels 172 and 176 are held together by a vertical support member 174 that includes a notch 174*a* for mating within the vertical slots 174, 178, in accordance with the construction step shown in FIG. 25*b*. A wedge locking member 182 is then pressed into the top of the slot 174 to lock the support member 181 therein, as shown in FIG. 25*c*. A similar approach is applied at the horizontal slots 175, 178 with a horizontal support component 184 and wedge locking member 185. Each of the locking members can include a flat edge, such as the member 182, or preferably a curved edge, such as edge 186 of the member 185 in order to produce the camming effect described above.

The two locking members solidly combine the two frame panels 172, 176 to form the completed picture frame 170. The vertical and horizontal positioning of the support members 174, 184 allow the picture frame to stand in two orientations.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected. Other style variations of furniture and accessories may readily incorporate the principles of the present invention.

Figure 13A:
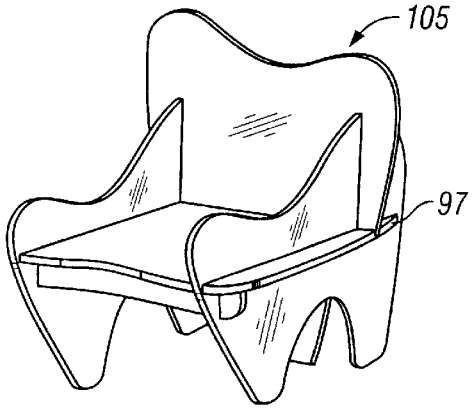
FIGS. 13*a*–*b* are perspective and front views of an asymmetric chair embodiment of the RTA furniture of the present invention.
Figure 13B:
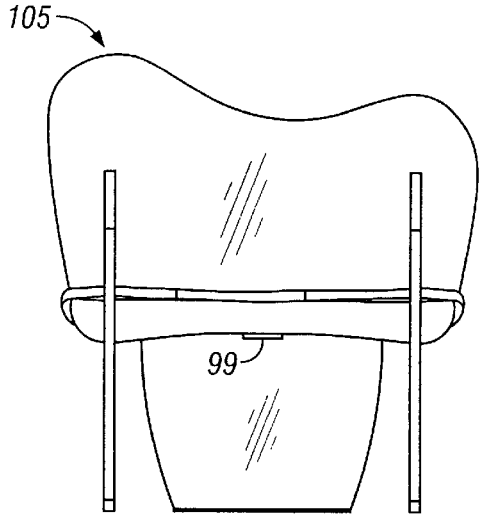

For instance, it can be appreciated from a comparison of the articles of furniture shown in the figures that the wedge locks can be of a wide range of sizes and configurations. The wedge lock 18 for the chair shown in FIG. 1*a* is tapered, while the wedge lock 80 shown in FIG. 9*a* is more rectangular in outer shape, and the wedge lock 97 in FIG. 13*a* is more rounded. Likewise, the wedge locks can have different exposed lengths, as can be seen by comparing the wedge lock 18 of FIG. 1*a* to the wedge lock 97 of FIG. 10*a*.

What is claimed is:

1. An article of ready-to-assemble (RTA) furniture comprising:

a pair of commonly-configured side panels, each having a closed slot extending along a substantial portion of the length of said side panel;

a base panel having a front edge and opposite side portions with side edges, said side portions configured to fit through and extend outward from said closed slot in a corresponding one of said side panels, said base panel defining a notch offset inboard from each of said opposite side edges for interconnecting with said closed slot in a corresponding one of said side panels as said base panel is moved toward one end of said closed slot; and a locking member configured to wedge between an opposite end of said closed slot and said side portion of said base panel when said side portion extends through said closed slot.

2. The article of RTA furniture of claim 1, wherein:

said side panels define ground-engaging legs; and said closed slot is arranged at a non-parallel angle relative to said ground engaging-legs.

3. The article of RTA furniture of claim 1, wherein said locking member defines an edge and said locking member is configured to wedge between said opposite end of said closed slot and said side portion of said base panel with said locking member edge substantially contiguous with said side edge of said base panel.

4. The article of RTA furniture of claim 1, further comprising:

a back panel having opposite side edges and defining a notch offset inboard from each of said side edges, said notch sized to receive a top edge of a corresponding one of said side panels therein, said back panel including an extension defined between said side edge and said notch, wherein said extension extends between said side portion of said base panel and said locking member so that said locking member is wedged between said extension and said opposite end of said closed slot to lock said extension and said side portion to a corresponding one of said side panels.

5. The article of RTA furniture of claim 4, wherein said locking member defines an edge and said locking member is configured to wedge between said opposite end of said closed slot and said extension and said side portion of said base panel with said locking member edge substantially contiguous with said side edge of said base panel and said side edge of said back panel.

6. The article of RTA furniture of claim 4, wherein:

said back panel includes a downward extending tab; and said base panel defines a back panel slot for receiving said tab therein.

7. The article of RTA furniture of claim 6, wherein said tab includes angled opposite walls configured to wedge within said back panel slot.

8. The article of RTA furniture of claim 6, wherein said downward extending tab includes a ground-engaging edge to help support the article of RTA furniture.

9. The article of RTA furniture of claim 6, wherein:

said tab of said back panel defines a base slot arranged to be situated adjacent the underside of said base panel when said tab extends through said back panel slot; and the article of furniture includes a second locking member configured to be wedged into said base slot with said locking member in engagement with said underside of said base panel.

10. The article of RTA furniture of claim 9, wherein said second locking member is elongate with opposite curved ends and having a length slightly longer than the length of said base slot.

11. The article of RTA furniture of claim 9, wherein:

said base panel includes a padded portion having a thickness greater than the thickness of said side portions;

said closed slot has a width sufficient for said padded portion to pass therethrough; and said base panel slot is arranged to contact the underside of said base panel when said side portions of said base panel are in contact with the upper side of said closed slot.

12. The article of RTA furniture of claim 6, wherein said pair of side panels defines at least two slots and the article of furniture includes a corresponding number of base panels and a corresponding number of locking members.

13. The article of RTA furniture of claim 12, wherein said extension extends only to a top-most one of said at least two slots of said pair of side panels.

14. The article of RTA furniture of claim 1, wherein said locking member includes an exposed edge and said locking member is configured so that said exposed edge is substantially coincident with a side edge of said base panel when said side edge extends through said closed slot and said locking member is wedged within said closed slot.

15. A ready-to-assemble (RTA) furniture system comprising:

a collection of identically-configured side panels, each having a closed slot extending along a substantial portion of the length of said side panels, said collection including sets of side panels having different aesthetic and functional characteristics;

a collection of base panels, each having a front edge and opposite side portions with side edges, said side portions configured to fit through and extend outward from said closed slot in a corresponding one of said side panels, said base panel defining a notch offset inboard from each of said opposite side edges for interconnecting with said closed slot in a corresponding one of said side panels as said base panel is moved toward one end of said closed slot, said collection including sets of base panels of different length and/or width dimension; and a collection of locking members configured to wedge between an opposite end of said closed slot and said side portion of said base panel when said side portion extends through said closed slot.

16. The RTA furniture system of claim 15, further comprising:

a collection of back panels, each having opposite side edges and defining a notch offset inboard from each of said side edges, said notch sized to receive a top edge of a corresponding one of said side panels therein, each of said back panels including an extension defined between said side edge and said notch, said collection including sets of back panels having different widths corresponding to the different widths of said sets of base panels, wherein said extension is configured to extend between said side portion of said base panel and said locking member so that said locking member is wedged between said extension and said opposite end of said closed slot to lock said extension and said side portion to a corresponding one of said side panels.

17. A ready-to assemble (RTA) lamp assembly comprising:

an elongated vertical panel having a ground-engaging portion and a closed vertical slot;

an elongated transverse panel configured to slid through said slot, said transverse panel having a ground-engaging portion with a notch defined therein, and a pair of spaced apart upper notches at an end of said transverse panel opposite said ground-engaging portion, said upper notches spaced apart a distance substantially equal to the thickness of said vertical panel, said transverse panel having a length less than the length of said closed vertical slot;

a pair of support members sized to be press-fit into a corresponding one of said upper notches;

a top plate having a slot therein for receiving said vertical panel therethrough, said top plate mountable over said vertical panel so that said top plate is supported on said support members when said support members are press-fit into said upper notches; and a locking member defining a curved portion configured to wedge into an upper portion of said vertical slot when, said transverse panel is disposed through said slot so that said locking member bears against said top plate to wedge said top plate against said support members.

18. The RTA lamp assembly of claim 17, wherein said top plate defines an opening for supporting a lamp fixture.

19. The RTA lamp assembly of claim 18, wherein said top plate further defines a second opening for passing an electrical wire therethrough.

20. A ready-to assemble (RTA) picture frame comprising:

a front panel configured for viewing a picture therethrough, a first vertical slot adjacent one edge of said front panel and a first horizontal slot adjacent an opposite edge thereof;

a backing panel defining a second vertical slot adjacent one edge of said front panel and a second horizontal slot adjacent an opposite edge thereof, wherein said first and second vertical slots and said first and second horizontal slots are coincident when said front panel and said backing panel are in coincident contact;

a first support component sized to extend through said first and second vertical slots when said slots are coincident, said first support component defining a ground-engaging edge;

a second support component sized to extend through said first and second horizontal slots when said slots are coincident;

a first locking member sized to be wedged into said first and second vertical slots when said slots are coincident and when said first support component extends therethrough; and a second locking member sized to be wedged into said first and second horizontal slots when said slots are coincident and when said second support component extends therethrough.

* * * * *